US005286935A

United States Patent [19]

Mina et al.

[11] Patent Number: 5,286,935

[45] Date of Patent: Feb. 15, 1994

[54] SELF-LOCATING, PREPOSITIONING ACTUATOR FOR AN ELECTRICAL SWITCH ENCLOSURE

[75] Inventors: Nabil L. Mina, Roselle, Ill.; James G. Johnson, Merrillville, Ind.

[73] Assignee: Appleton Electric Company, Chicago, Ill.

[21] Appl. No.: 51,525

[22] Filed: Apr. 22, 1993

[51] Int. Cl.[5] ..... H01H 3/20

[52] U.S. Cl. ..... 200/330; 200/331; 200/329; 74/104; 74/96

[58] Field of Search ..... 200/330, 329, 331, 332, 200/332.1, 335, 336, 337, 234, 43.01, 43.02, 43.07, 43.08, 43.14, 43.15; 335/9, 21; 74/104, 96

[56] References Cited

U.S. PATENT DOCUMENTS 5,111,009 5/1992 Chan et al. ..... 200/330

5,219,070 6/1993 Grunert et al. ..... 200/332

*Primary Examiner*—Renee S. Luebke
*Assistant Examiner*—David J. Walczak
*Attorney, Agent, or Firm*—Jones, Day, Reavis & Pogue

[57] ABSTRACT

An actuator means for an electrical switch concealed in a housing and operated by a handle externally mounted to the cover thereof, whereby, upon closing the cover, the actuator automatically moves in a rectilinear direction to locate the toggle operating lever of the switch and rotatably moves the externally viewed handle to preposition it to indicate the energization state of the switch. Alternatively, the actuator permits operation of the switch by rotating the externally accessible handle. This invention is especially suited to circuit breaker switches contained in explosion-proof or hazardous location-rated enclosures.

17 Claims, 4 Drawing Sheets

SELF-LOCATING, PREPOSITIONING ACTUATOR FOR AN ELECTRICAL SWITCH ENCLOSURE

BACKGROUND OF THE INVENTION

The present invention relates generally to electrical switch enclosures, and more specifically to an actuator mechanism for such an enclosure that automatically locates and prepositions an externally viewed handle upon closing the enclosure cover to reflect the true operational state of the switch contained therein.

Switches for use in electrical circuits associated with machinery and other equipment are well known in the art. Used alone or in a group, they control the flow of electrical current. As disclosed by U.S. Pat. No. 3,284,731 issued to Nicol, they may take the form of a toggle switch with a lever that is manually operated between "on" and "off" positions to energize or deenergize the switch, thereby completing or interrupting the electrical circuit. They may likewise comprise a circuit breaker switch having a tripping mechanism that automatically interrupts the electrical circuit in response to an infrequent, abnormal condition like an overly high voltage, as taught by U.S. Pat. No. 2,560,628 issued to Brown, and U.S. Pat. No. 3,771,081 issued to Strobel.

Such switches are frequently placed in protective housings when used in explosive atmospheres or otherwise harsh environments. These housings are commonly cast from aluminum with one-half-inch-thick walls to prevent or contain explosions, moisture penetration, etc. A mating cover permits access to the switch mechanism contained therein. These switches normally feature a handle on the exterior of the enclosure that is operatively connected to the switch toggle lever contained inside the enclosure in order to permit operation of the switch without the need to remove the enclosure cover. In the case of explosion-proof or hazardous location-rated enclosures, such an externally operated switch may be a necessity.

U.S. Pat. No. 3,264,443 issued to Farina et al., U.S. Pat. No. 3,287,514 issued to Bachman, and U.S. Pat. No. 3,422,238 issued to Rys et al. disclose designs for such an externally mounted handle that is operatively connected to the toggle switch inside the enclosure by an actuator rod. In the case of Farina, the handle and rod are simply moved toward or away from the enclosure side wall to move the toggle switch between the "on" and "off" positions. Bachman and Rys, by contrast, teach a structure by which rotational movement of the externally mounted handle is translated by an actuator mechanism into rectilinear movement of the toggle switch between the "on" and "off" positions. In both Farina and Bachman, however, the handle is mounted to the side of the enclosure, and the actuator mechanism is permanently connected to the toggle switch. Such a design, though, would be impossible for a cover-mounted handle in which the actuator mechanism must be readily detachable from the toggle switch in order to permit opening of the cover to provide access to the switch.

It is also known in the trade to provide an externally mounted handle on the cover of the enclosure. In U.S. Pat. No. 1,989,393 issued to Anderson, for example, a rectilinearly biased external handle engages the toggle switch mounted inside the enclosure, and moves in parallel therewith. U.S. Pat. No. 2,180,501 issued to Blood discloses a handle that is detachably connected to the toggle switch by means of a clip, and slid in a direction parallel with the operational direction of the toggle switch. U.S. Pat. No. 2,610,272 issued to Platz, by contrast, uses a rotary-mounted handle connected to an actuator mechanism that raises or lowers a movable contactor in a direction normal to the handle, thereby completing and interrupting the electrical circuit. U.S. Pat. No. 1,924,351 issued to Doddridge, U.S. Pat. No. 2,752,464 issued to Seeger, U.S. Pat. No. 4,612,424 issued to Clark et al., and U.S. Pat. Nos. 3,742,401 and 3,771,081 issued to Strobel use handles connected directly or indirectly to a clip or other mechanism that translates the resulting rotary motion of the handle into rectilinearly biased movement that operates the toggle switch. The EWP Panel Board sold by Appleton Electric Company, the assignee of the present invention, uses a similar mechanical principal. Upon reattaching the cover to the enclosure of such devices, however, the externally mounted handle will not necessarily reunite with the toggle switch without cumbersome and difficult operator alignment. Moreover, the handle position may be out of phase with the operational state of the toggle switch, thereby indicating that the switch is "off" when, in fact, it is energized, and creating a safety hazard to an unaware operator. The two parts may not become realigned once again until the handle is rotated successively over time to the "off" and "on" positions.

SUMMARY OF THE INVENTION

Accordingly, it is an object of the present invention to provide an externally operated switch in an explosion-proof or hazardous location-rated enclosure.

Another object of the present invention is to provide such an apparatus having an easily rotated handle that indicates the true operational state of the switch concealed in the housing.

Still another object of the present invention is to provide such an apparatus in which the handle is mounted to the exterior of the cover of the enclosure, while permitting the cover to be opened to obtain access to the switch.

Yet another object of the present invention is to provide such an apparatus having an actuator mechanism operated by the externally mounted handle that automatically locates the toggle switch concealed in the enclosure when the cover of the enclosure is closed.

Still another object of the present invention is to provide such an apparatus having an actuator mechanism that automatically prepositions the externally-mounted handle to reflect the true operational state of the toggle switch concealed in the enclosure upon closing the enclosure cover.

Other objects of the invention, in addition to those set forth above, will become apparent to those skilled in the art from the following disclosure.

Briefly, the invention is directed to providing an actuator means for an electrical switch concealed in a housing and operated by a handle externally mounted to the cover thereof, whereby, upon closing the cover, the actuator automatically moves in a rectilinear direction to locate the toggle operating lever of the switch and rotatably moves the externally viewed handle to preposition it to indicate the energization state of the switch. Alternatively, the actuator means permits operation of the switch by means of rotating the externally accessible handle. This invention is especially suited to circuit breaker switches contained in explosion-proof or hazardous location-rated enclosures.

DETAILED DESCRIPTION OF THE PREFERRED EMBODIMENT

Figure 1:
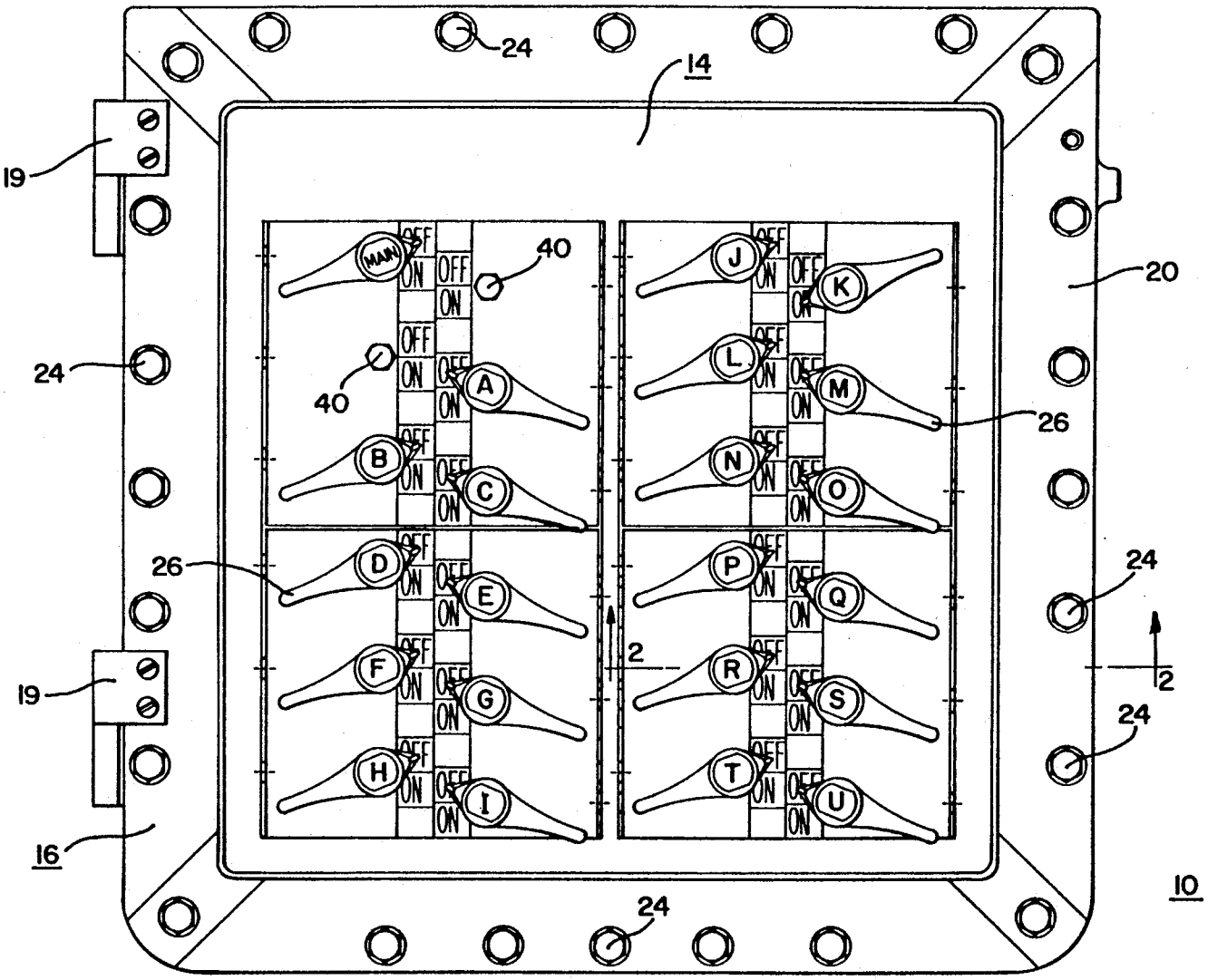
FIG. 1 shows a plan view of a panel board enclosure, having a plurality of operator handles associated with a like number of electrical switches contained in the enclosure.
Figure 2:
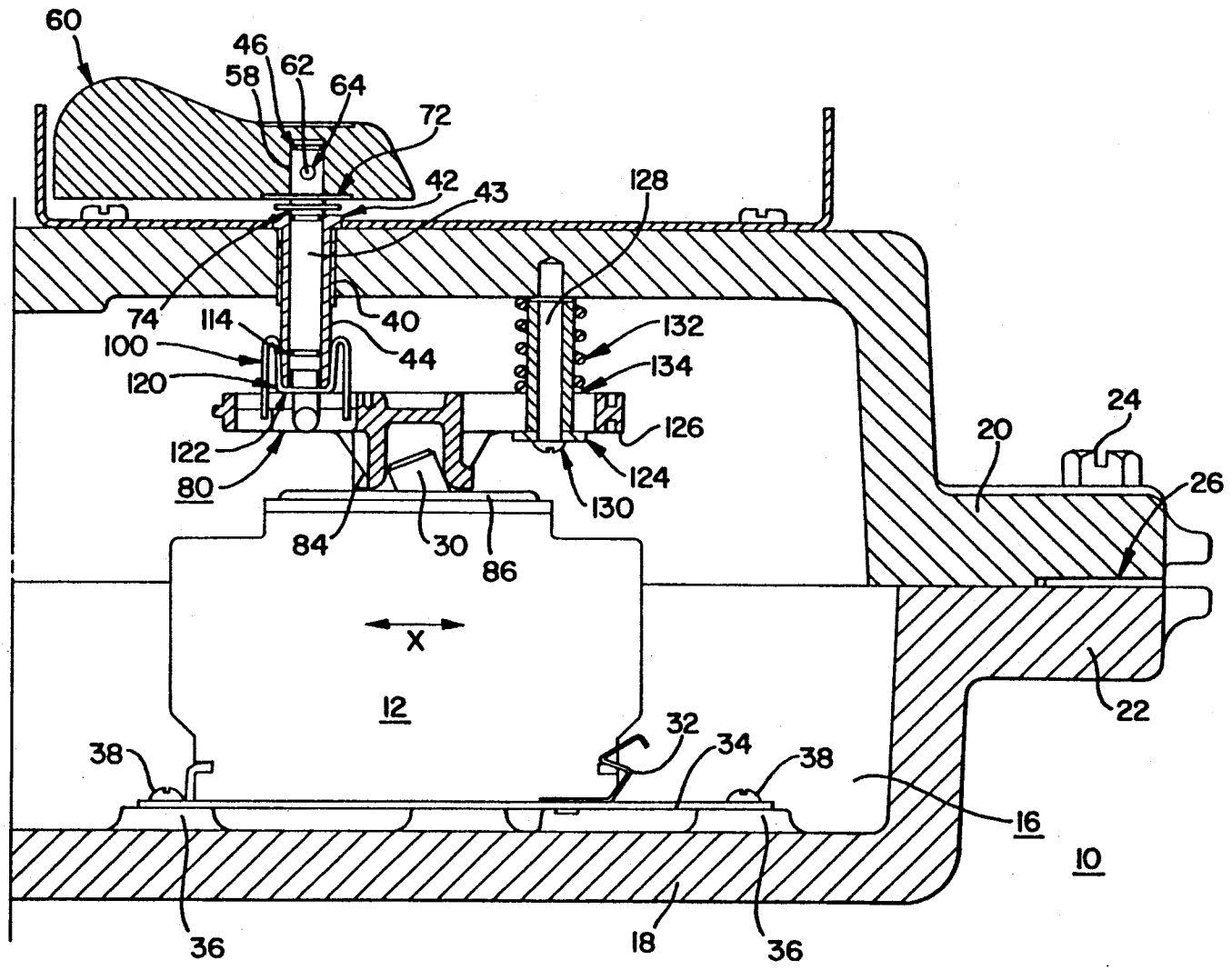
FIG. 2 shows a sectional view of the panel board enclosure taken along line 2—2 of FIG. 1.

As illustrated in FIGS. 1-2 of the drawings, a panel board 10 containing a plurality of switches 12 may be used in association with electrical circuits for machinery and other industrial equipment. The panel board 10 comprises the cover 14 of an explosion-proof or hazardous location-rated enclosure 16 also having a body portion 18. The cover and body portions are made from a suitably strong material, such as cast aluminum with one-half-inch-thick walls, are operatively connected by means of hinges 19, and have mating flanges 20 and 22, respectively, around their perimeters. Flanges 20 and 22 are connected by means of bolts 24 to provide an explosion-proof, moisture-resistant environment therein for the switches 12. A gasket 26 made from a suitable material like urethane may be interposed between the flanges to provide a liquid-tight seal therebetween. Mounted to the panel board cover 14 are a plurality of handles 26 that are pivotable between an "off" position and an "on" position.

A cut-away side view is provided in FIG. 2 of one of the switches 12 contained in enclosure 16. Switch 12 may comprise any of the toggle switches or circuit breakers known in the prior art. Externally protruding from switch 12 is toggle lever 30, which may be used to convert the switch between the energized "on" position and the deenergized "off" position. Lever 30 is pivotable, as is commonly known, in a rectilinear direction X. Switch 12 is secured by means of clip 32 to bracket 34, which in turn is fastened by means of screws 38 to bosses 36 that are integrally connected to the bottom of enclosure body 18. In this manner, the securement means does not interfere with the air and liquid-tight integrity of enclosure 16, while permitting simple addition and removal of switch 12 for maintenance purposes.

Located in enclosure cover 14 is aperture 40. Aperture 40 is tapped with screw threads (not shown). Bushing 42 having external threads (not shown) and wrench surface 43 is screwed into position inside aperture 40. Bushing 42 has a bore 44 with smooth side walls therein. Bushing 42 may be made from stainless steel.

Figure 3:
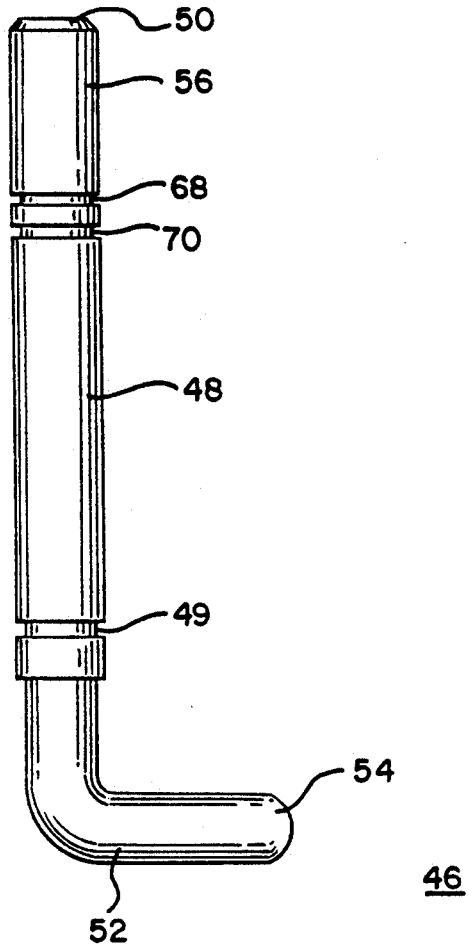
FIG. 3 shows a side view of the actuator shaft of the present invention.

Interposed through bore 44 is breaker actuator shaft 46 having a diameter that is slightly less than that of bushing bore 44. Breaker actuator shaft 46 is shown in more detail in FIG. 3. It comprises a shank portion 48 having a chamfered end 50. The other end is integrally connected to a foot portion 52 positioned at a 90° angle thereto. The distal end 54 of foot portion 52 may be rounded.

Located near the chamfered end 50 of shank portion 48 is through bore 56. Chamfered end 50 of breaker actuator shaft 46 is then inserted into cylindrically shaped pocket 58 in actuator handle 26, which has a through bore 62 located normal to the longitudinal axis of pocket 58. Through bores 56 and 62 cooperate to allow passage of pin 64 therethrough to provide a secure connection between handle 26 and actuator breaker shaft 46. Handle 26 may be made from a lightweight, protected material like epoxy-coated aluminum, and pin 64 formed from a strong material, such as stainless steel.

Located along shank 48 of actuator breaker shaft 46 are annular grooves 68 and 70. Groove 68 is used to engage C-ring 72 for purposes of keeping shaft 46 from passing into enclosure 16. O-ring 74 made from an elastomeric material like rubber is secured inside groove 70, and provides a liquid-tight seal between shaft 46 and bushing wall 42 to prevent moisture penetration into enclosure 16.

Figure 4:
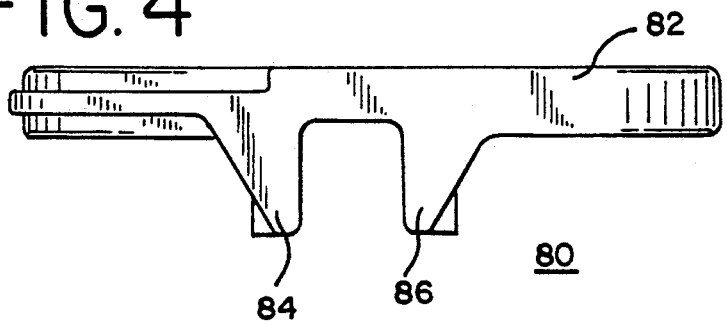
FIG. 4 shows a side view of the breaker actuator of the present invention.
Figure 5:
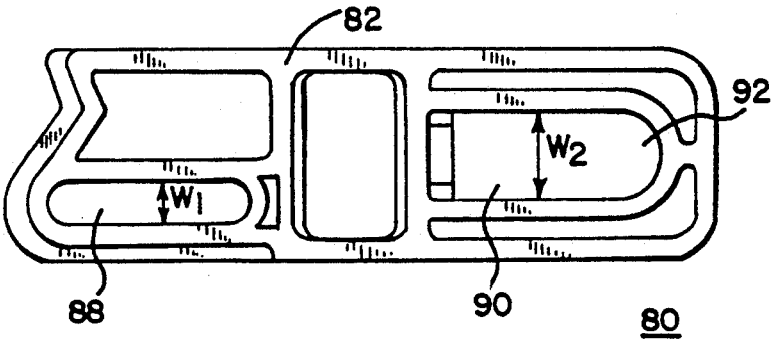
FIG. 5 shows a plan view of the breaker actuator of FIG. 4.
Figure 6:
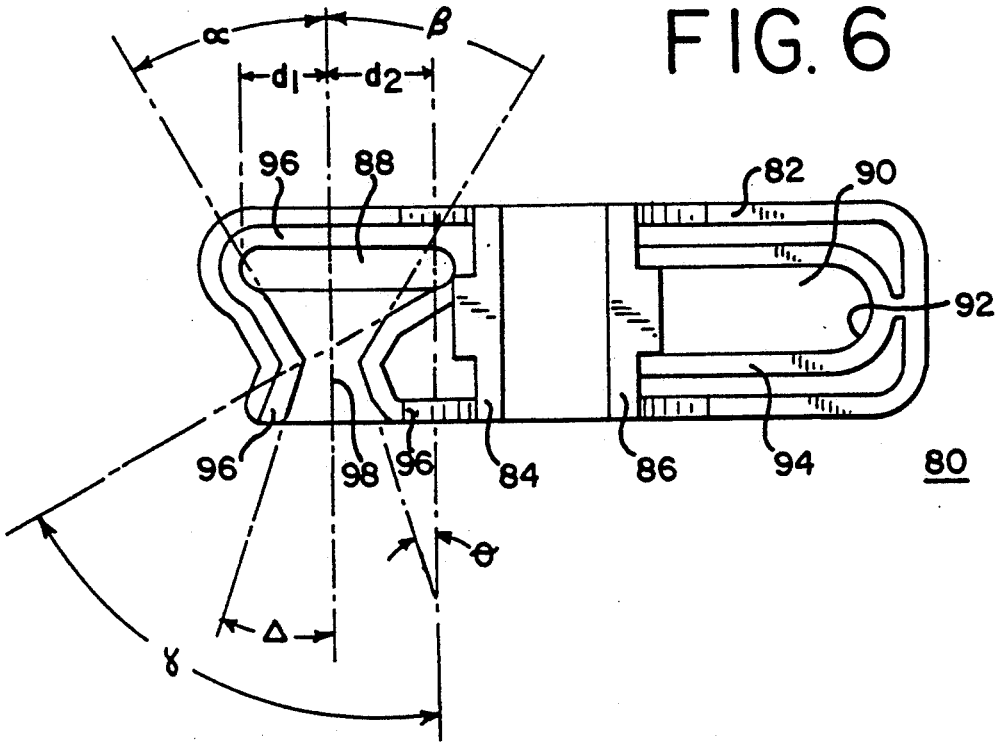
FIG. 6 shows a bottom view of the breaker actuator of FIG. 4.

Breaker actuator 80 is shown in greater detail in FIGS. 4-6, and may be made from a light-weight material like anodized aluminum. It comprises a base 82 having two feet 84 and 86 depending therefrom. Located in base 82 is slotted aperture 88 having a width $w_1$, and a larger slotted aperture 90 having a rounded end 92 and a width $w_2$ equal to the diameter of a circle corresponding to the rounded portion 92 thereof. Integrally connected to the bottom surface of base 82 is a wall 94 surrounding the perimeter of aperture 90, and a second wall 96 surrounding a portion of the perimeter of aperture 88, and defining an open recess 98.

Figure 7:
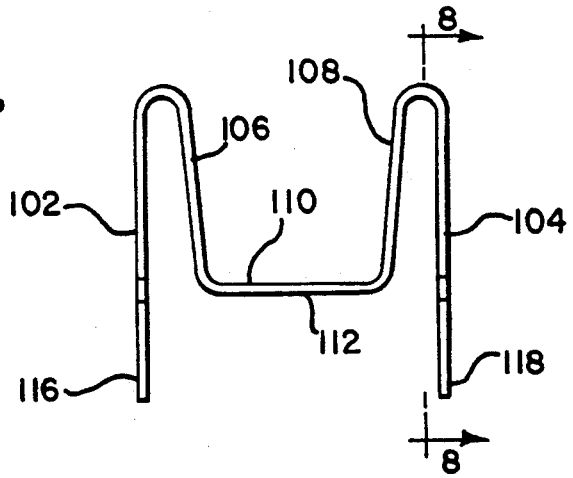
FIG. 7 shows a side view of the position spring of the present invention.
Figure 8:
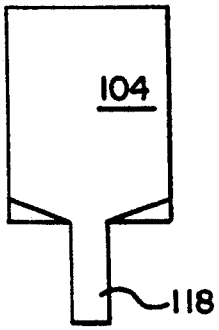
FIG. 8 shows an end view of the position spring of FIG. 7.

Feet 84 and 86 of breaker actuator 80 straddle toggle lever 30 of switch 12 and come into contact therewith. Foot portion 52 of actuator shaft 46 is passed from the top surface of actuator 80, through aperture 88, and finally rotated 90 degrees so that it enters recess 98, and is confined by perimeter wall 96. Actuator position spring 100, shown more clearly in FIGS. 7 and 8, is saddle-shaped, having side walls 102 and 104, inner walls 106 and 108, and bottom wall 110. Located in the center of bottom wall 110 is aperture 112, having a diameter slightly larger than the diameter of foot portion 52 of actuator shaft 46. Annular groove 49 located along shank 48 near the junction with foot portion 52 secures elastomeric O-ring 114.

Integrally attached to the distal ends of side wall 102 and 104 of position spring 100 are protrusions 116 and 118, which have a width less than width $w_1$ of aperture 88. After foot portion 52 of actuator shaft 46 is passed through aperture 112 in bottom wall 110 of spring 100, protrusions 116 and 118 are fitted into slotted aperture 88. Nylon washers 120 and 122 may be placed on either side of spring 100 to reduce surface abrasion of bushing 42, spring 100, and actuator 80. Spring 100 serves to limit movement of actuator 80 with respect to toggle lever 30 of switch 12.

Meanwhile, guide sleeve 124 made from a material like nylon is passed through larger aperture 90 in actuator 80 so that flange 126 abuts the bottom surface of perimeter wall 94, and the other end 128 abuts the inner surface of cover 14. Screw 130 is passed through guide sleeve 124 and connected to cover 14 to secure breaker actuator 80 thereto. Stainless steel spring 132 is positioned between the top base surface 82 of actuator 80 and cover 14 to accommodate movement of actuator 80 toward cover 14 as actuator feet 84 and 86 strike switch toggle lever 30 and ride up along the surface thereof. Spring 132 ensures that actuator 80 remains in contact with toggle lever 30. It also prevents actuator 80 from breaking if cover 14 is closed in the wrong position with respect to switch 12 and toggle 30. Washer 134 applies a solid surface against which spring 132 may bear.

Operation of the breaker actuator 80 of the present invention is as follows. Cover 14 may be opened in order to obtain access to switch 12 for maintenance purposes. In doing so, actuator 80 will likewise be disengaged from contact with toggle lever 30 due to its connection to cover 14 by means of screw 130 and actuator shaft 46.

When cover 14 is closed once again with flanges 20 and 22 abutting each other, feet 84 and 86 of actuator 80 will seek out and automatically locate toggle lever 30, sliding along the inclined surface thereof, since longitudinally oriented slots 88 and 90 provide freedom of movement of actuator 80 with respect to screw 130 and actuator shaft 46 in a direction parallel to the direction of operational movement of toggle lever 30. Spring 132 will ensure that actuator 80 remains in constant contact with toggle lever 30 during this self-location orientation. At the same time, perimeter wall 96 of actuator 80, which is moving rectilinearly in the X direction, will contact foot portion 52 of actuator shaft 46, and thereby bias it in a similar direction, causing shank portion 48 to rotate in the process. In so doing, actuator handle 26 connected to shaft 46 will rotate along panel board 10 to indicate the correct position of toggle switch lever 30. Thus, actuator 80 not only self-locates toggle lever 30, but also automatically prepositions actuator handle 26 to reflect the true state of switch 12.

The dimensions and angular relationship of perimeter wall 96 is important towards achieving this prepositioning function by actuator 80. In a preferred embodiment, perimeter wall 96 is 0.09 inches wide. The distance $d_1$ is approximately 0.399 inches, while the distance $d_2$ is approximately 0.463 inches. Angles $\alpha$ and $\beta$ are approximately 31°, angle $\gamma$ is approximately 60°, angle $\Delta$ is approximately 21°, and angle $\ominus$ is approximately 30°.

It should be understood that actuator 80 may likewise be used in the reverse process to translate rotational force imparted to shaft 46 by handle 26 to rectilinear force imparted to toggle lever 30 in the X direction by actuator feet 84 and 86. Thus, handle 26 may be used to control switch 12 from outside enclosure 16.

While particular embodiments of the invention have been shown and described, it should be understood that the invention is not limited thereto, since many modifications may be made. For example, actuator shaft 46 could be made from more than one part. The angles and dimensions of perimeter wall 96 of actuator 80 also could be modified, depending upon the size and shape of the various parts of the breaker actuator mechanism of the present invention. The invention is therefore contemplated to cover by the present application any and all such modifications which fall within the true spirit and scope of the basic underlying principles disclosed and claimed herein.

What is claimed is:

1. A self-locating, prepositioning operating means for an electric switch, comprising:

(a) a housing having an openable cover;

(b) a switch mounted in said housing, and having a toggle lever pivotably connected thereto for converting said switch between an energized state and a deenergized state;

(c) an actuator shaft passing through an aperture in the cover and rotatably mounted thereto, said shaft having a first end and a second end, the first end being connected in a fixed relationship to an externally viewed operator handle, a portion of said shaft located inside said housing and providing a bearing surface;

(d) an actuator plate having two parallel feet depending therefrom, a first and second longitudinal slot near respective ends of said plate that are positioned parallel to the direction of pivotable movement of the toggle lever, and a cam surface adjacent to the first longitudinal slot, said actuator shaft passing through the first longitudinal slot so that the bearing surface thereof may contact the cam surface of said actuator plate while said actuator plate may freely move with respect to said actuator shaft; and (e) connection means passing through the second longitudinal slot for securing said actuator plate to the cover, while permitting movement of said actuator plate with respect thereto, whereby, upon closing of the cover, the feet of said actuator plate automatically locate the toggle lever of said switch and come into contact therewith, imparting rectilinear force in the toggle lever movement direction to said actuator plate, the cam surface of said actuator plate bearing against the bearing surface of said actuator shaft to translate the rectilinear movement of said actuator plate into rotational movement of said actuator shaft so that said operator handle is automatically prepositioned to indicate the energization state of said switch concealed in said housing.

2. A switch operating means as recited in claim 1, wherein the bearing surface of said actuator shaft contacts the cam surface of said actuator plate to translate rotational movement of said actuator shaft imparted by said operator handle to rectilinear movement of said actuator plate in a direction parallel to the pivotable direction of the toggle lever of said switch, the feet of said actuator plate biasing the toggle lever from one energization state to the other, whereby said externally accessible operator handle may operate said switch concealed in said housing.

3. A switch operating means as recited in claim 1, wherein said connection means comprises a screw.

4. A switch operating means as recited in claim 1, further comprising a spring positioned between said actuator plate and said cover to bias the feet of said actuator plate into engagement with the toggle lever of said switch when said enclosure cover is closed.

5. A switch operating means as recited in claim 1, further comprising spring means engaging said actuator shaft and actuator plate so that movement of said actuator plate is limited with respect to the toggle lever of said switch.

6. A switch operating means as recited in claim 5, wherein said spring means comprises a clip having an aperture for accepting passage of said actuator shaft, and protrusions at each distal end thereof for mounting in the first longitudinal slot of said actuator plate.

7. A switch operating means as recited in claim 1, wherein the cam surface of said actuator plate comprises a multiple-sided wall surrounding at least a portion of the perimeter of the first longitudinal slot, and extending across the bottom surface of said actuator plate to define a recess for containing the bearing surface of said actuator shaft, while restricting the rotational movement of said shaft.

8. A switch operating means as recited in claim 1, wherein the bearing surface of said actuator shaft comprises a portion of said shaft located between the first and second ends thereof, said portion bearing an angled relation to the remaining portion of said shaft.

9. A switch operating means as recited in claim 8, wherein said angled relation comprises a 90° angle.

10. A switch operating means as recited in claim 1, further comprising at least one sealing means positioned along said actuator shaft for providing a moisture resistant seal between said actuator shaft and said housing cover.

11. A switch operating means as recited in claim 10, wherein said sealing means comprises an elastomeric O-ring.

12. A switch operating means as recited in claim 1, further comprising means for releasably securing said switch to the bottom of said housing.

13. A switch operating means as recited in claim 12, wherein said securing means comprises a flexible clip.

14. A switch operating means as recited in claim 1, further comprising one or more additional switches mounted in said housing, and a corresponding number of switch operating means for operating said switches and being prepositioned by said switches to indicate their energization state.

15. A switch operating means as recited in claim 1, wherein said housing comprises an explosion-proof enclosure.

16. A switch operating means as recited in claim 1, wherein said housing comprises a hazardous location-rated enclosure.

17. A switch operating means as recited in claim 1, wherein said electrical switch comprises a circuit breaker.

* * * * *